US009466233B2

(12) United States Patent
Weightman et al.

(10) Patent No.: US 9,466,233 B2
(45) Date of Patent: Oct. 11, 2016

(54) ANTIFRAUD DEVICE FOR GARMENTS AND OTHER CONSUMER PRODUCTS AND DEVICES AND SYSTEM AND METHOD RELATED THERETO

(75) Inventors: Barbara A. Weightman, Oakland, NJ (US); Jean C. Bellifemine, Franklin Lakes, NJ (US); Matthew Bellifemine, Franklin Lakes, NJ (US)

(73) Assignee: AVERY DENNISON RETAIL INFORMATION SERVICES, LLC, Westborough, MA (US)

( * ) Notice: Subject to any disclaimer, the term of this patent is extended or adjusted under 35 U.S.C. 154(b) by 76 days.

(21) Appl. No.: 12/552,445

(22) Filed: Sep. 2, 2009

(65) Prior Publication Data

US 2010/0050487 A1 Mar. 4, 2010

Related U.S. Application Data

(60) Provisional application No. 61/094,081, filed on Sep. 4, 2008.

(51) Int. Cl.

| | |
|---|---|
| ***E05B 73/00*** | (2006.01) |
| ***G09F 21/02*** | (2006.01) |
| ***G08B 13/24*** | (2006.01) |
| ***G09F 3/02*** | (2006.01) |

(52) U.S. Cl.

CPC ..... *G09F 21/02* (2013.01); *G08B 13/248* (2013.01); *G08B 13/2448* (2013.01); *G09F 3/02* (2013.01); *E05B 73/00* (2013.01)

(58) Field of Classification Search

CPC ..... G09F 3/14; G09F 3/04; G09F 3/005; G09F 3/18; G09F 3/00; E05B 73/0017; A47F 7/024

USPC ..... 40/6, 633, 665

See application file for complete search history.

(56) References Cited

U.S. PATENT DOCUMENTS

| | | | |
|---|---|---|---|
| 4,211,995 | A | 7/1980 | Smith |
| 4,540,092 | A | 9/1985 | DeSantis |
| 4,685,572 | A | 8/1987 | Jamison |
| 4,956,982 | A | 9/1990 | Valley |
| 4,986,457 | A | 1/1991 | Faris |

(Continued)

FOREIGN PATENT DOCUMENTS

| | | | |
|---|---|---|---|
| DE | 19882240 | T1 | 5/2000 |
| EP | 245430 | A1 | 11/1987 |

(Continued)

OTHER PUBLICATIONS

The Loss Prevention Research Council, in conjunction with The Retail Equation, Customer Returns in the Retail Industry, Published Nov. 19, 2008, Relevant pp. 4, and 5.

(Continued)

*Primary Examiner* — Cassandra Davis

(74) *Attorney, Agent, or Firm* — Avery Dennison Retail Information Services, LLC

(57) ABSTRACT

The present invention relate to an anti-fraud return device that deters persons from temporarily using garments and or other consumer goods for a short period of time and then returning them to a merchant for a refund, exchange or credit. The present invention includes a strip of material formable into a fixed loop that may be provided with one or more security features.

10 Claims, 5 Drawing Sheets

(56) References Cited

U.S. PATENT DOCUMENTS

| | | | | |
|---|---|---|---|---|
| 5,016,758 | A | 5/1991 | Ward | |
| 5,025,963 | A | 6/1991 | Goldfarb | |
| 5,151,684 | A | 9/1992 | Johnsen | |
| 5,154,072 | A | 10/1992 | Leyden | |
| 5,279,135 | A | 1/1994 | Leyden | |
| 5,345,219 | A | 9/1994 | Rogers | |
| 5,538,289 | A * | 7/1996 | Cassis, III | 283/74 |
| 5,624,514 | A | 4/1997 | Frowein | |
| 5,667,877 | A * | 9/1997 | Tajiri et al. | 428/195.1 |
| 5,973,598 | A * | 10/1999 | Beigel | 340/572.1 |
| 6,303,201 | B1 * | 10/2001 | Baierl et al. | 428/40.1 |
| 6,349,493 | B1 * | 2/2002 | Newman et al. | 40/633 |
| 7,628,317 | B2 | 12/2009 | Fowler | |
| 2007/0018832 | A1 * | 1/2007 | Beigel et al. | 340/572.7 |
| 2008/0088125 | A1 * | 4/2008 | Montross | 283/80 |
| 2009/0115615 | A1 * | 5/2009 | Bleckmann et al. | 340/572.8 |
| 2009/0135014 | A1 | 5/2009 | Bleckmann | |

FOREIGN PATENT DOCUMENTS

| | | | |
|---|---|---|---|
| EP | 296943 | B1 | 10/1991 |
| EP | 495022 | B1 | 4/1995 |
| EP | 654098 | B1 | 12/1996 |
| EP | 0900903 | B1 | 5/2004 |
| FR | 2646198 | A1 | 10/1990 |
| FR | 2695203 | A1 | 9/1991 |
| FR | 2660840 | A1 | 10/1991 |
| GB | 2458945 | A | 10/2009 |
| WO | WO-9009648 | | 8/1990 |

OTHER PUBLICATIONS

"Retailers Who Say Return Policies at Their Company Have Changed to Address Return Fraud", NRF Return Fraud Survey, Conducted Oct. 2-27, 2006; National Retail Federation, Nov. 1, 2006.

"Return Fraud to Hit $3.7 Billion this Holiday Season, According to NRF Survey", National Retail Federation, Nov. 7, 2007.

* cited by examiner

ANTIFRAUD DEVICE FOR GARMENTS AND OTHER CONSUMER PRODUCTS AND DEVICES AND SYSTEM AND METHOD RELATED THERETO

CROSS-REFERENCE TO RELATED APPLICATION

This application claims the benefit of U.S. Provisional Patent Application No. 61/094,081 filed Sep. 4, 2008, which application is assigned to the same assignee as this application and whose disclosure is incorporated herein by reference in its entirety.

FIELD OF THE INVENTION

The present invention generally relates to antifraud device for garments, electronic articles, consumer products and other devices that prevent unwanted conduct, e.g. theft or other misappropriation by individuals and avoid monetary loss by retailers.

BACKGROUND OF THE INVENTION

According to the National Retail Federation, US retailers lost $9.6 billion in 2006 and $10.8 billion in 2007 to return fraud. Return fraud refers to the practice of criminals taking advantage of retailers return policies, by seeking cash or credit for stolen goods. A type of return fraud is the practice known as "wardrobing", which while not illegal has a substantial impact on retailers. Wardrobing is the practice of purchasing garments or apparel, using them, and then returning them to the store for a refund. A major problem with wardrobing is that it can strip the retailer of the most popular size, colors and styles so that honest consumers cannot purchase the goods. Auditioning is another form of return fraud in which a person purchases an item, such as a computer or radio, using the item and then returning the item to a store for a refund. Often, the retailer cannot resell these goods and instead may either have to discard the goods or resell the goods at deep discounts. "Price arbitrage" consists of buying an item that looks similar but has a lower price, then returning the cheaper item as though it was a more expensive item. The foregoing practices unfortunately cause retailers to raise prices.

Flexible cable devices for use as securing devices and anti-theft devices are well known. Examples include U.S. Pat. No. 4,540,092 to Desantis, U.S. Pat. No. 4,956,982 to Valley, U.S. Pat. No. 5,016,758 to Ward, U.S. Pat. No. 4,986,457 to Faris, U.S. Pat. No. 5,151,684 to Johnsen and U.S. Pat. No. 5,154,072 to Leyden, all of which are incorporated herein in their entirety. The previously mentioned references represent devices that are not designed for removal from the retail establishment nor are they designed to allow removal by the consumer. The devices disclosed in these references are typically metal cables or such that are designed to prevent theft from the retail establishment and are always removed before a purchased item leaves the store. The relatively high cost of these devices precludes the notion that they would ever be taken home by the consumer and discarded.

The Loss Prevention Research Council, in conjunction with The Retail Equation announced "Customer Returns in the Retail Industry" survey results. Using 2007 retail data and 2008 survey results, the study revealed that return fraud and abuse is a $15.5 billion problem. The majority of retailers (64%) report that focusing on reducing refund fraud is a high priority.

While many devices have been created to prevent shoplifting, little or no attention has been paid to the area of wardrobing and auditioning. Hence, there remains a need for an effective method of curtailing this practice. The present invention is intended to curtail the issues associated with this problem.

SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

One embodiment of the antifraud device of the present invention is a wardrobing prevention device in the form of a strip of material that loops through at least one opening and possibly two or more openings in a garment and which is permanently affixed to form a permanent loop of material. In order to wear the garment for daily use, the wardrobing prevention device would need to be removed by severing or otherwise destroying the integrity of the loop by the consumer. While the wardrobing prevention device would not preclude one from auditioning the garment, the looped strip would be a visible deterrent should the garment be worn in public without removing the wardrobing prevention device. The color and design of the strip could be altered so as to either be subtle with respect to the design or coloration of the garment or be a bold contrast to the design or coloration of the garment. The wardrobing prevention device, if removed would thus prevent the return of the consumer good for refund or credit as the absence of the device would show that it had been removed either due to a valid transaction or other nefarious activity reducing the value of the product. The device is intended to be a single use, disposable device that is destructible by the consumer or retailer on request.

In contrast to the flexible cable devices in the prior art, the current invention is designed so that the consumer can comfortably try on the garment or item, simulate actual conditions and then the consumer can take the item home to decide if they wish to keep the item and if they do decide to keep the item, the wardrobing prevention device can be easily removed by the consumer. The cost of the wardrobing prevention device is minimal and as such does not need to be reused as is the case for the above mentioned anti-theft devices in order to justify the expense associated with such devices. Also, in the case of the cable based anti-theft devices for garments, the weight and bulkiness of these devices prevents proper wearing of a garment because of the distortion the device creates by hanging within the garment. In contrast, embodiments of the current invention directed to garments are made of materials that are not heavy or bulky and thus do not tend to hang upon a garment in such a way as to distort it during the act of trying them on. Their primary purpose is not to prevent theft but rather to serve as a visual deterrent to wardrobing and return fraud.

In another exemplary embodiment of the presently described antifraud device of the present invention, the engagement or securing strip could be highly colored or have printed warning indicia that indicates that the garment could not be returned for a refund, credit or exchange if the strip were severed or removed from the garment. This printing could include serial numbers, brand identifiers, advertisements, coupons, promotional offerings, linked offerings, bar coding and other alpha-numeric coding or indicia, continuous patterns (e.g. chains, bands, logo lines, etc.) which may indicate that if cut the consumer good could not be returned. The indicia can be machine readable, human readable or a combination of both.

In a still further exemplary embodiment of the present invention, a wardrobing prevention system for a garment is presented and includes an elongated strip of material having a tear resistance of greater than about 5 pounds. The strip is planar and has a central portion that is sized and configured to fit through an opening in a garment. The strip has first and second longitudinally extending sides and first and second transversely extending edges with at least one of the edges having an attachment feature. A garment that has at least one opening and wherein the strip is placed through the at least one opening and the first and second ends are secured to one another by the attachment feature.

A yet still further exemplary embodiment is provided and includes an auditioning prevention device for consumer goods that includes (a) a strip of material that has first and second ends, first and second sides and a central portion between the first and second ends; (b) each of the first and second ends are configured to attach to one another permanently to form a locked loop; and (c) the strip of material is positioned so as to be interoperatively engaged with a consumer good to form a secured consumer good having the locked loop.

A still further exemplary embodiment of the present invention includes a method for reducing return fraud, that includes the steps of initially providing a garment that has at least one opening then providing a strip of material with the strip of material having first and second ends, first and second sides and an attachment feature disposed on at least one of the first and second ends and a central portion. Next, the central portion of the strip of material is printed with at least human readable indicia and machine readable indicia to provide a deterrent; and the strip of material is placed through the at least one opening to form a loop by bringing the first and second ends of the strip of material toward one another. Finally, the first and second ends of the strip of material are secured to one another to create a return fraud prevention device.

In yet another embodiment of the antifraud device, the strip could contain an alarm device that would sound if the strip were removed in the store. The alarm could be deactivated at check-out.

In another, more detailed feature of the antifraud device of the invention, the alarm could be reactivated if the item were returned to the store and put back into inventory.

In another embodiment of the antifraud device, the strip is of a tubular construction which is looped through a garment or around a device and be permanently affixed to itself.

In still another embodiment of the antifraud device, the strip could contain a RFID circuit or other device that would allow for tracking, inventory control and identification.

In a further embodiment of the antifraud device, an EAS or other device may be added to the strip to allow the strip to interact with shoplifting control devices within the store.

In yet another embodiment of the antifraud device, the strip could contain items such a holograms or other anti-counterfeiting measures or a combination thereof.

The present invention may also include other features such as reinforcing strips, e.g. wire, Tyvek®, string or the like to make the anti-wardrobing device more difficult to cut.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE INVENTION

These, as well as other features, aspects, and advantages of this invention, will be more completely understood and appreciated by referring to the following more detailed description of the exemplary embodiments of the invention in conjunction with the accompanying drawings, of which:

Figure 2:
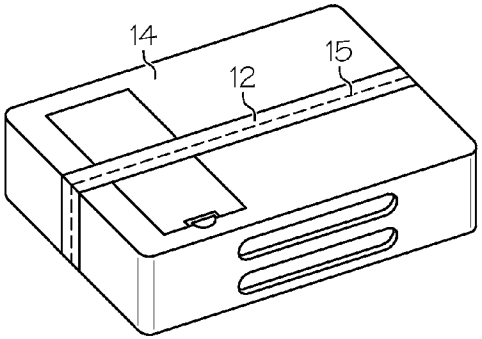
FIG. 2 is a sectional view of an auditioning prevention device being attached to an electronic device.

Unless otherwise indicated, the illustrations in the above figures are not necessarily drawn to scale.

DETAILED DESCRIPTION OF THE INVENTION

The present invention is now illustrated in greater detail by way of the following detailed description, which represents the best presently known mode of carrying out the invention. However, it should be understood that this description is not to be used to limit the present invention, but rather, is provided for the purpose of illustrating the general features of the invention.

The basic construction of the wardrobing prevention device of this invention is such that the strip of material is long enough to accomplish the intended protection of the garment or device and that the strip has a means for attaching to itself so as to form a permanent loop of material.

The strip can be constructed of any material that is not easily torn or ripped during transportation, sale and auditioning, but can easily be severed by the consumer. Preferably the material is of low cost and can be printed or imaged or could serve as a carrier for promotional offers, such a "piggyback" construction in which a label or coupon could be removably attached the strap for later redemption by the consumer. The strip can be a flat fabric like structure or it can be tubular in design. Woven and non-woven materials and plastic films which meet these criteria would be suited for this application. As an example, Tyvek® by Dupont Corp of Wilmington, Del. could be used. Likewise, many types of polymer tubing could be used. In most cases, a tear strength of greater than 5 pounds (per ASTM D 1117) serves this purpose, however stronger material may also be used, having a tear strength of greater than about 10 pounds. Alternatively, the strip of material can include reinforcing bands or strips in order to add additional strength to the device. While the device has a particular tear or burst strength, the device is intended to be a single use, disposable device which can be destroyed, cut, torn, etc. by the consumer or retailer if necessary.

Sealing of the flat materials could be accomplished using hand held ultrasonic welding devices or by the use of permanent pressure sensitive adhesives. Sealing of tube like devices could be accomplished using a wide assortment of couplers that would permanently insert into the open ends of the tubing to form a continuous loop of tubing. A snap connector or interlocking device could also be employed in both the flat and tube constructions.

Printing of the flat strips could be accomplished using any number of printing techniques including but not limited to offset, gravure, thermal transfer, hot stamping, non impact printing (such as ink-jet or laser) and letterpress. Likewise, printing techniques for tubing are well known. Indicia printed on the strips could include the store name, the store location, brand identifiers, coupons, serial numbers, bar codes, manufacturing dates or codes, repetitive security patterns and a warning that the item is not returnable for exchange or refund if the strip is removed or severed. Additional warnings about the inclusion of alarm devices, etc could be added to the strips as well.

Figure 1:
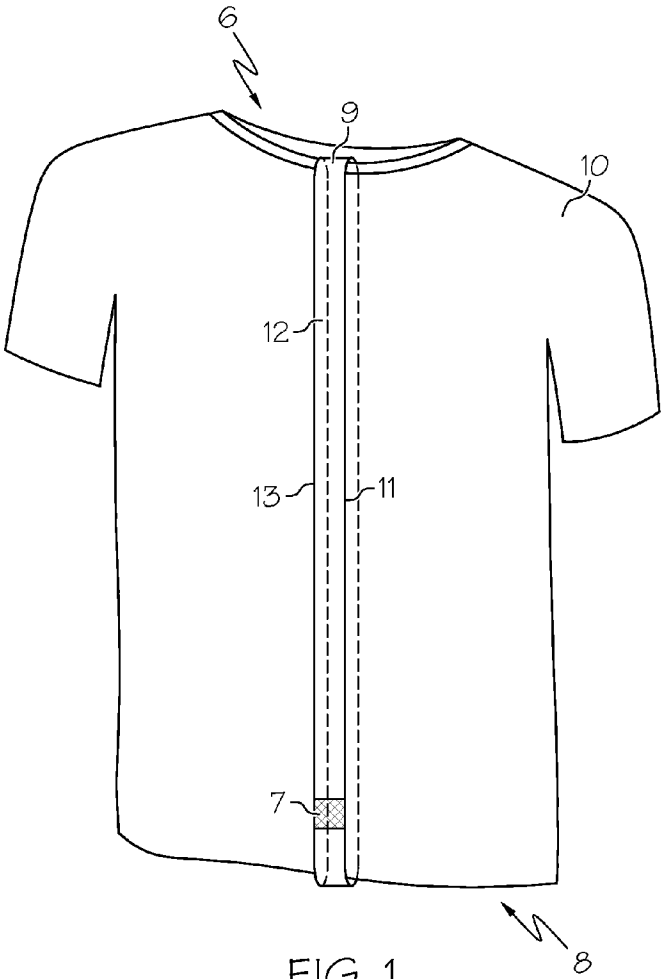
FIG. 1 is a sectional view of one embodiment of the wardrobing prevention device attached to a garment.
Figure 7:
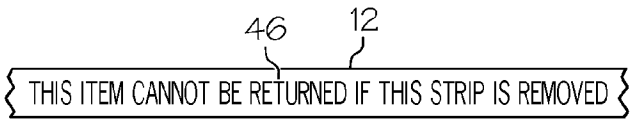
FIG. 7 is a sectional view of an antifraud device with exemplary text.

FIG. 1 shows one embodiment where a strip of flat construction 12 is attached to a garment 10. The strip 12 is shown looping through a first opening 6 of the garment 10 and exiting a second opening 8. It should however be understood that the strip 12 may only loop through a single opening such as a button hole or the like in a garment. The strip 12 has generally longitudinally extending side edges 11 and 13 and a central portion 9 upon which indicia may provides such as shown in FIG. 7. If reinforcing strips (not shown) are provided, they may be provided along one or more of the longitudinally extending side edges 11 and 13 or in the central portion 9.

The strip 12 may also be temporary affixed to the garment through adhesive or light stitching which is shown by reference numeral 7 in FIG. 1. With a temporary attachment the strip 12 may then not get tangled with the customer causing any interference with auditioning the garment 10.

Figure 1A:
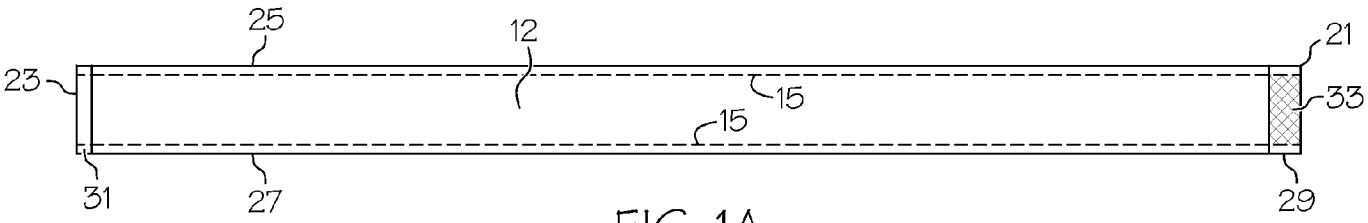
FIG. 1A is a front elevational view of the wardrobing prevention device.

FIG. 1A provides a front elevational view of a generally planar strip 12 and includes first and second longitudinally extending sides 25 and 27 and first and second transversely extending ends 21 and 23, the sides 25 and 27 having a greater length than of either of the ends 21 and 23. Disposed adjacent the sides 25 and 27 are reinforcing bands 25 and 27. While two bands are illustrated, there may only be a single band or multiple bands may be provided. For example, there could be a number of reinforcing fibers that run generally parallel to the side edges 25 and 27 or there could be other patterns used to improve tear resistance. Disposed on each of the ends 21 and 23 are the areas for attachment 29 and 31. As illustrated, end 29 is provided with a pressure sensitive adhesive 33 as an attachment feature to allow the loop to be formed around the article to be secured. The attachment feature is shown as provided on at least one of the ends, but the attachment can be provided on both ends, such as with a cohesive arrangement, hook and loop fasteners, etc.

Figure 1B:
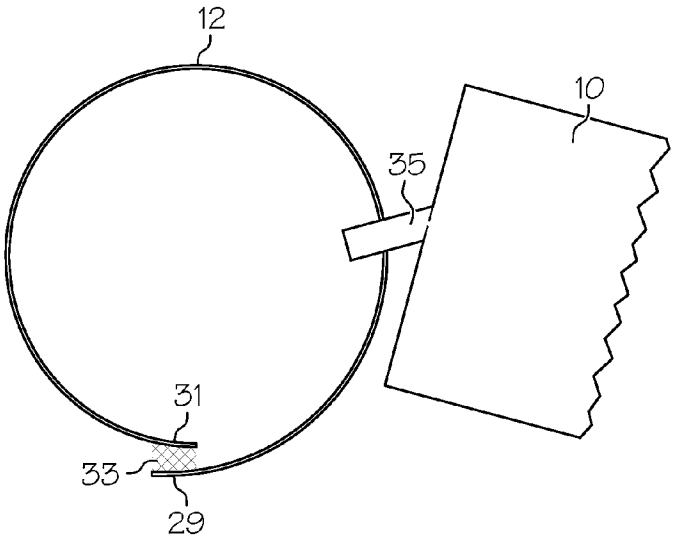
FIG. 1B is a side view showing the wardrobing prevention device attached to a belt loop or other single opening of an article to be secured.

FIG. 1B shows the strip 12 connected to a belt loop 35 of a garment to illustrate the embodiment that the strip 12 can be attached to a single opening on an article such as a garment 10. It should however be understood that the opening could be a button hole, eyelet for shoes, purse handles, fashion accessories (e.g. belts, purses) or the like and that the current embodiment is not intended to be limited but can include anything having at least one opening. FIG. 1B further illustrates the attachment of the ends 29 and 31 to one another via a pressure sensitive adhesive 33. It should be understood that other types of adhesive may be used, such as a hot melt adhesive, cohesive or other attachment configurations could be used such as hook and loop fasteners, mechanical fasteners (e.g. staples, rivets) or such other fasteners as may be appropriate.

FIG. 2 shows one embodiment where a strip of flat construction 12 is attached to an electronic device 14 such that the strip 12 precludes opening or access to the battery compartment. In this embodiment, the strip 12 is securely fastened to the device 14 such as by tension, although a removable, repositionable or other pressure sensitive adhesive may be used to hold the strip 12 in position on the device 14. A reinforcing strip 15 (is shown in FIG. 2 in phantom) disposed in the central portion 9 of the strip 12. The reinforcing strip 15 can also be used to aid in carrying the device 14 from the retail location.

Figure 3:
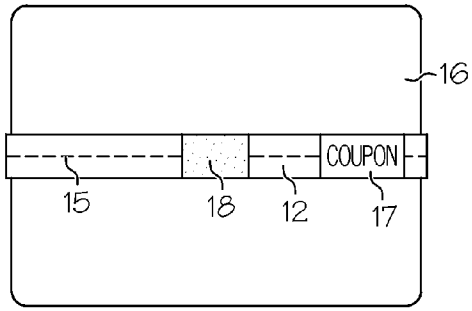
FIG. 3 is a sectional view of another auditioning prevention device having an EAS or RFID device incorporated into it.

FIG. 3 shows one embodiment where a strip 12 having a flat construction is attached to an electronic device 16. The strip 12 contains a RFID or EAS device 18, or other security device such as an ink cartridge which can rupture upon improper removal. Exemplary RFID or EAS devices for use herein are available from Avery Dennison Corporation of Pasadena Calif. The EAS device can be used in connection with a security system at a retail location, such as to prevent shoplifting and the RFID device can be used for inventory purposes as well as tracking of the goods while they are in range of the stores reader systems. In addition, if a reinforcing strip 15 is provided and constructed of a conductive material (e.g. aluminum, copper, etc.), the strip can form part of the antenna system for the RFID device, such as an RFID inlay being parasitically coupled to the reinforcing strip, such that when the strip 12 is broken the read range of the RFID inlay is significantly reduced thereby possibly alerting store monitoring systems.

FIG. 3 also shows a coupon 17 or other promotional item attached to the strip 12. This can be done in a piggy back fashion (easily removable from the strip) or alternatively could be a portion that is intended to be removed as part of a customer loyalty promotion.

Figure 4:
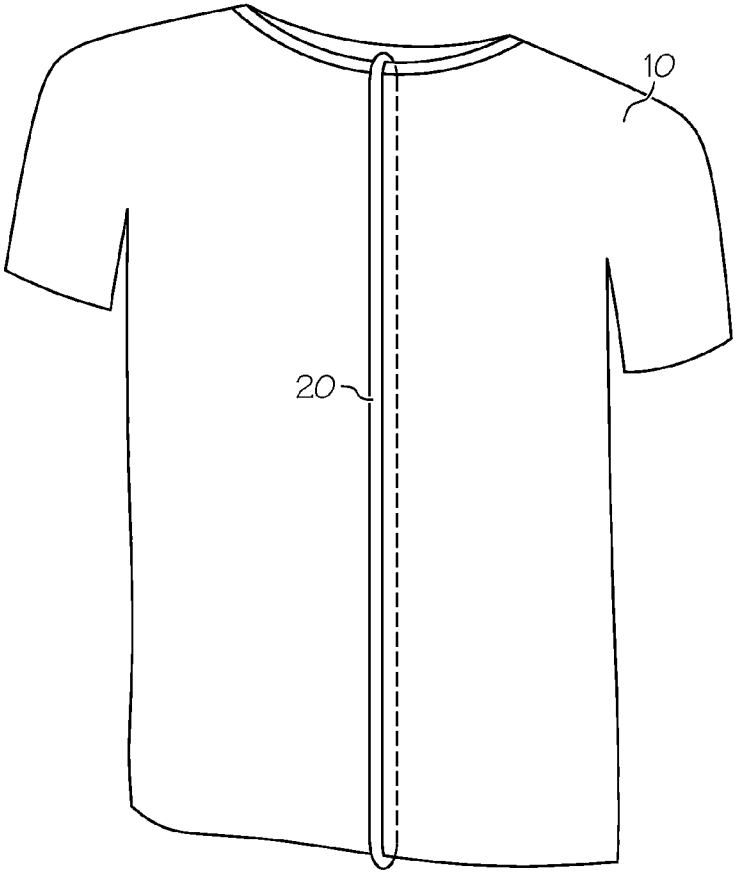
FIG. 4 is a sectional view of another wardrobing prevention device which is tubular in design.

FIG. 4 shows one embodiment where a strip of tubular construction 20 is attached to a garment 10. The strip 20 may also contain a reinforcing element internally of the tube. While reference is made to a tube which may be generally cylindrically shaped, the tube can have other geometric configurations which may add to a particular branding initiative of the retailer or consumer product manufacturer.

Figure 5:
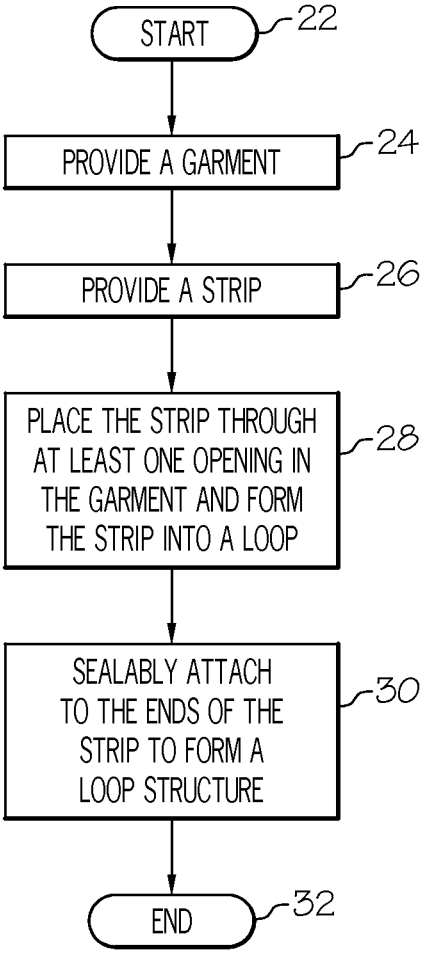
FIG. 5 is a flowchart of an exemplary method for applying a wardrobing prevention device to a garment.

FIG. 5 shows an exemplary method of attaching a strip 12 to a garment 10. A method is described wherein at step 24 a garment or a consumer good is provided and at step 26 a strip is provided. At step 28 the strip is placed through at least one pre-existing openings in the garment and the strip is formed into a loop such that it encircles at least a portion of the garment. (See also FIG. 1). Examples of pre-existing openings in a garment include: openings for the neck, arms, legs or torso of the person wearing the garment or other openings such as button holes, belt loops, slits, etc. At step 30 the ends of the strip are sealably attached to one another to form a permanent loop structure. The strip 12 would be positioned so as to not interfere with a consumer wearing the garment while deciding whether to purchase and retain the garment. The strip is applied so as to be very close to the garment yet loose enough so as to allow an arm or leg to be easily put through the opening of the garment while not distorting the appearance of the garment to allow a consumer to try on merchandise in order to determine if it is suitable for his or her needs. If the strip 12 is placed through a button hole or other similar opening, then of course the ease of auditioning a garment may be further facilitated.

Figure 6:
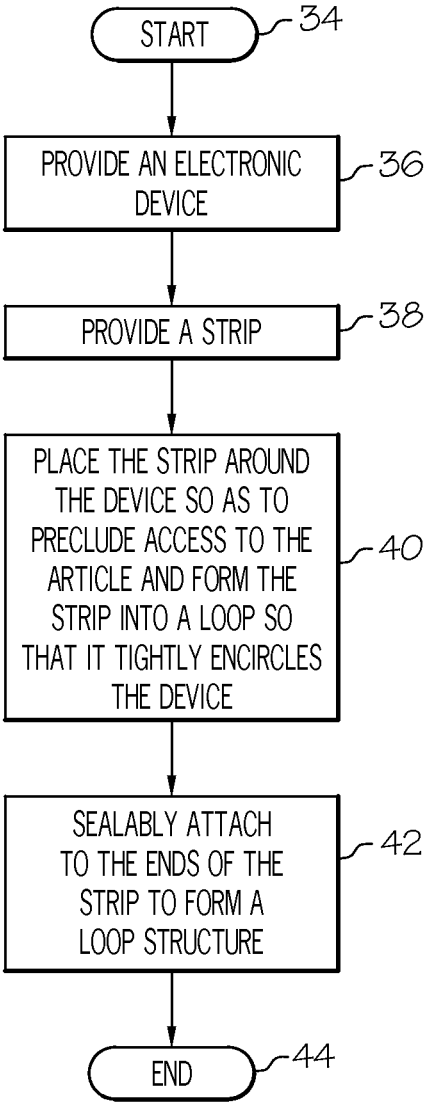
FIG. 6 is a flowchart of an exemplary method for applying a wardrobing prevention device to an electronic device.

FIG. 6 shows an exemplary method of attaching a strip 12 to an electronic device or other consumer good that it may be preferable to secure. 14. A method is described wherein at step 36 an electronic device is provided and at step 38 a strip is provided. At step 40 the strip is placed around the device so as to preclude access to the battery compartment or the controls of the device and the strip is formed into a loop so that it tightly encircles the device. At step 42 the ends of the strip are sealably attached to form a permanent loop structure.

FIG. 7 shows one embodiment where strip 12 is imprinted with indicia 46. The indicia may take the form of alpha and/or numeric characters, logo lines, repetitive patterns or the like, any one of which if broken would indicate that the strip had been tampered and as such not subject to a return policy or presentable for a refund.

It will thus be seen according to the present invention a highly advantageous anti fraud device has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. A fraud-prevention device and system for visible attachment to consumer goods, the fraud-prevention device comprising: an elongated destructible strip of material comprising:

i) first and second longitudinally extending sides, and first and second transversely extending edges with at least one of the first and second extending edges having an attachment means, the elongated destructible strip of material is plastic having a tear resistance of greater than 22 Newtons, the strip is planar has a central portion and is sized and configured to fit through an opening in a garment; a consumer good having at least one opening; wherein the strip is placed through the at least one opening and the first and second ends are secured to one another by the attachment feature ii) at least one security feature selected from the group consisting of an RFID tag, an EAS tag, a rupturable ink cartridge, and hologram;

iii) security indicia including at least one of logo lines, repetitive patterns, characters, or numerals; and iv) at least one reinforcing strip wherein the at least one reinforcing strip is constructed out of a conductive material and the reinforcing strip is a part of an antenna system for a RFID tag and such that breaking the reinforcing strip reduces the read range of the RFID tag.

2. The fraud-prevention device of claim 1 wherein the consumer good is selected from a group consisting of garments, apparel, shoes, and accessories.

3. The fraud-prevention device of claim 1, wherein a. each of the first and second edges being configured to attach to one another permanently to form a locked loop;

b. wherein the strip of material is positioned so as to be interoperatively engaged with a consumer good to form a secured consumer good having the locked loop; and wherein the security indicia visually misaligns upon removal of the strip from the secured consumer good.

4. The fraud-prevention device of claim 3 wherein the strip of material contains non-security indicia.

5. The fraud-prevention device of claim 4 wherein the non-security indicia includes at least one of a warning message, serial number, bar code, brand identifier, advertisement or coupon.

6. A method for reducing return fraud using the fraud-prevention device and system as set forth in claim 1, comprising the steps of:

providing a garment having at least one opening;

providing the fraud-prevention device as set forth in claim 1 wherein the strip of material has a central portion, placing a warning device on the strip of material;

printing the central portion of the strip of material with at least human readable indicia and machine readable indicia to provide a deterrent;

placing the strip of material through the at least one opening;

forming a loop by bringing the first and second ends of the strip of material toward one another; and securing the first and second ends of the strip of material to one another to create a return fraud prevention device.

7. The fraud-prevention device of claim 1, wherein the strip of material is selected from a group consisting of a flat-woven material, a flat non-woven material, and a tubular material.

8. The fraud-prevention device of claim 1, wherein the attachment means is selected from a group consisting of pressure-sensitive adhesives, hot-melt adhesives, cohesives, mechanical fasteners, ultrasonic welding, and hook and loop fasteners.

9. The fraud-prevention device of claim 1, further comprising indicia having at least one of a serial number, bar code, brand identifier, advertisement, warning message, manufacturing date, store identifier, or coupon.

10. The fraud-prevention device of claim 9, wherein the coupon is attached on a separate substrate attached to the strip.

* * * * *